United States Patent [19]

Schelhorn et al.

[11] Patent Number: 4,647,900

[45] Date of Patent: Mar. 3, 1987

[54] HIGH POWER THICK FILM RESISTOR

[75] Inventors: Robert L. Schelhorn, Vincentown, N.J.; Colleen A. Matier, Andalusia, Pa.

[73] Assignee: RCA Corporation, Princeton, N.J.

[21] Appl. No.: 766,284

[22] Filed: Aug. 16, 1985

[51] Int. Cl.[4] ..... H01C 1/012; H01C 1/01

[52] U.S. Cl. ..... 338/314; 338/308; 338/309; 338/320

[58] Field of Search ..... 338/308, 307, 309, 314, 338/320

[56] References Cited

U.S. PATENT DOCUMENTS

| | | | |
|---|---|---|---|
| 4,123,741 | 10/1978 | Kiyono et al. | 338/121 |
| 4,243,969 | 1/1981 | Steigerwald et al. | 338/309 |
| 4,245,210 | 1/1981 | Landry et al. | 338/314 |
| 4,259,657 | 3/1981 | Ishikawa et al. | 338/22 R |

*Primary Examiner*—Harold Broome
*Assistant Examiner*—Linda M. Peco
*Attorney, Agent, or Firm*—Birgit E. Morris; Donald S. Cohen

[57] ABSTRACT

A high power thick film resistor having improved power handling capability is obtained with a resistor having two overlying thick film layers wherein the first thick film layer has a relatively low resistivity and the second thick film layer has a relatively high resistivity.

4 Claims, 1 Drawing Figure

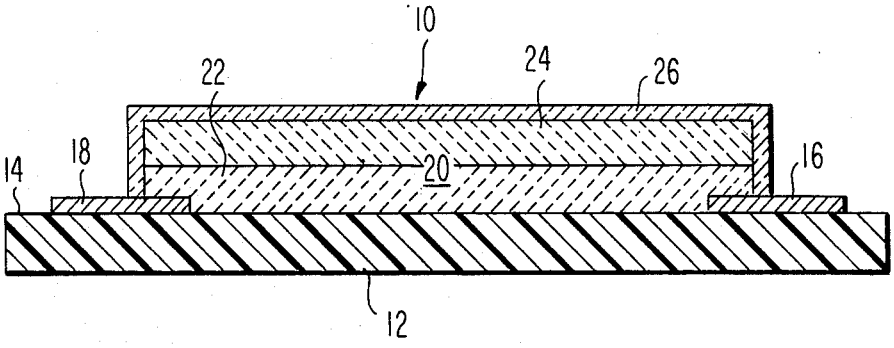
10
22
24
26
14
18
20
16
12

HIGH POWER THICK FILM RESISTOR

This invention relates to a novel high power thick film resistor and more particularly is concerned with a thick film resistor having a relatively small surface area and substantially improved resistance stability and increased power handling capacity as compared to conventional thick film resistors.

BACKGROUND OF THE INVENTION

The term "thick film resistor" as used in the electronics industry refers to the method employed to fabricate a resistor rather than the relative thickness of the individual layers of material which comprise the resistor. In the manufacture of a thick film resistor, especially formulated conductor and resistor pastes are applied to and fired on a substrate in a predetermined sequence. In the manufacture of conventional prior art thick film resistors, a conductor paste, which typically contains a precious metal such as gold, is printed on a substrate in a predetermined pattern, dried and then fired to form a pair of spaced apart metal terminals. Thereafter, a layer of a resistor paste, which is typically comprised of a mixture of a dielectric glass frit and electrically conductive particles, is printed on the substrate between and in electrical contact with the terminals. The resistor paste is dried and then fired which causes the glass frit to fuse, forming a resistor body having a glassy matrix with conductive particles distributed throughout the matrix. The resistance of the resistor which is obtained is determined to a large extent by the relative amount of conductive particles in the resistor body.

In certain applications, such as in high power microwave transmission, it is often necessary that the resistors be capable of handling relatively large amounts of power. To provide such resistors, it is common practice to increase the surface area of the resistor by widening or lengthening the resistor body. This permits greater power dissipation and maintains the operating temperature of the resistor below the point where destructive, irreversible changes occur. However, increasing the surface area of thick film resistors is not a satisfactory solution in microelectronic applications because they occupy excessively large surface areas of the devices.

In order to overcome the inherent problems of conventional thick film resistors, a novel type of resistor structure was suggested by Landry et al. in U.S. Pat. No. 4,245,210 entitled "Thick Film Resistor Element And Method Of Fabrication," the disclosure of which is hereby incorporated by reference. The Landry et al. resistor is comprised of a substrate, a pair of terminals and a series of from, for example, at least three and up to ten or even more overlying layers of a high resistivity material. The use of multiple layers of high resistivity materials, as taught by Landry et al., has made it possible to form low resistance resistors with improved power handling and high voltage capability.

The Landry et al. resistors, however, do have certain shortcomings. The fabrication of the Landry et al. resistors require multiple printing, drying and firing steps in order to deposit a sufficient number of layers of high resistivity material. The relatively large number of firing steps, in addition to increasing the production cost of the Landry et al. resistors, also tends to cause the conductive particles in the resistor composition of each of the previously fired layers to migrate towards the upper surface of the resistor structure. The resulting migration of the conductive particles causes the final resistor structure to have relatively low resistance adjacent the upper surface and relatively high resistance adjacent the substrate and terminals. This results in a substantial reduction of the power handling capability of the multiple layered resistors taught by Landry et al.

What would be highly desirable would be a resistor smaller in area than a conventional thick film resistor which is simpler to fabricate than the Landry et al. resistor and which has improved power handling capabilities.

SUMMARY OF THE INVENTION

It has been found that a resistor having improved high power handling capability can be obtained by providing a resistor with two layers, a first layer of a low resistivity material and an overlying layer of a high resistivity material.

BRIEF DESCRIPTION OF THE DRAWING

The FIGURE is an elevational, cross-sectional illustration of the novel resistor of this invention.

DETAILED DESCRIPTION OF THE INVENTION

The resistor 10 of this invention is comprised of a substrate 12 having a surface 14, a pair of spaced apart terminals 16, 18 attached to the surface 14, and a resistor body 20. The resistor body 20 is comprised of a first thick film layer 22 having a relatively low resistance and a second overlying thick film layer 24 having a relatively high resistance.

The substrate 12 is comprised of an electrically insulating heat conductive material. Various well known materials can be employed for the substrate 12, such as aluminum oxide or preferably beryllium oxide. The substrate 12 as illustrated is generally rectangular in configuration. It should be appreciated, however, that the substrate 12 can be of other shapes and relative sizes with the shape and the size generally being determined by the specific application of the resistor 10 and the requirement that the substrate 12 have sufficient bulk to be an effective heat sink for the heat generated during the operation of the resistor 10 of this invention.

The terminals 16, 18 are spaced apart from each other and are attached to the surface 14 of the substrate 12. The terminals 16, 18 are formed on the surface 14 of the substrate 12 using conventional thick film technology and are preferably made of gold.

The first and second layers 22, 24 of the resistor body 20 can be formed from various well known resistor materials which have different resistivities. The components which comprise the materials, such as the glass frit and/or the conductive material employed, can be the same or different. It has been found, however, that the optimum results are obtained if the first and second thick film layers 22, 24 are made from the same resistor materials but with different relative amounts of the components to provide thick film layers having a relatively high or relatively low resistance as specified hereinafter.

The first thick film layer 22 is attached to the surface 14 of the substrate 12 between the terminals 16, 18 and extends over and is in electrical contact with a portion of the terminals 16, 18. The first thick film layer 22 is formed from a resistive material having a relatively low resistivity. The first thick film layer 22 is applied to the surface 14 of the substrate 12 and portions of the terminals 16, 18 by printing, drying and then firing in the conventional manner.

The second thick film layer 24 of resistive material is then formed over the first thick film layer 22. A resistor material which when fired has a relatively high resistivity as compared to the resistor material used for the first thick film layer 22 is applied over the surface of the first thick film layer 22, dried and then fired. Care must be taken in the firing of the second thick film layer 24. The firing should be conducted at a sufficient temperature and for a sufficient time to insure that the resistor material is fully fused and electrical contact is made with the surface of the first thick film layer 22. Excessive firing temperatures and particularly excessively long firing times should be avoided in order to prevent migration of the conductive particles from the first layer 22 to the surface of the second layer 24 in order to avoid the problems of the type encountered with the Landry et al. resistor. The exact temperatures and times which are employed are dependent upon the particular resistive material used to form each layer.

The difference in the resistance of the first thick film layer 22 and the second thick film layer 24 can be varied over wide limits. It has been found, however, that the optimum results are obtained with regard to the operation of the resistor 10 of this invention if the resistivity of the second thick film layer 24 is approximately ten times greater than the resistivity of the first thick film layer 22.

After the first and second thick film layers 22, 24 have been formed, a layer 26 of a hermetic sealing dielectric glass can optionally be applied over the resistor body 20 in order to protect the resistor body 20 from moisture and physical damage.

The resistor 10 of this invention has a number of advantages over the resistors heretofore employed. The first thick film layer 22 having a low resistance handles the major current density thus providing higher power handling capability for the resistor 10. Furthermore, the second thick film layer 24 having a relatively high resistance provides a relatively smooth resistor surface which blends in with the inherently rough surface characteristics of the low resistance first layer 22, thus improving the high voltage performance of the resistor 10. An additional advantage of the resistor 10 of the present invention is that the resistor body 20 is obtained with only two firing steps. In addition, the high glass content of the resistor material used for the second thick film layer 24 and the low concentration of metal at the top of the resistor body 20 prevents the development of high current densities at the surface. This results in a high power, high voltage resistor which can be fabricated with a minimum number of process steps.

What is claimed is:

1. A thick film resistor capable of handling high power comprising:

an electrically insulative, heat conductive substrate having a surface;

a pair of spaced apart terminals attached to the surface; and a resistor body consisting of two continuous thick film layers, a first layer in contact with said substrate having a first resistance and extending between and being in electrical contact with said terminals and a second layer having a second resistance which is substantially greater than said first resistance overlying and being contiguous and in electrical contact with said first layer.

2. The thick film resistor according to claim 1 wherein the resistance of the second layer is approximately ten times greater than the resistance of the first layer.

3. The thick film resistor according to claim 1 having a hermetic dielectric layer overlying the resistor body.

4. The thick film resistor according to claim 1 wherein the first and second thick film layers are comprised of resistor materials consisting of the same components in different proportions sufficient to impart said first resistance to said first layer and said second resistance to said second layer.

* * * * *